US010428570B2

(12) United States Patent
Lorenzani et al.

(10) Patent No.: US 10,428,570 B2
(45) Date of Patent: Oct. 1, 2019

(54) WIND SAFE DOOR

(71) Applicant: Entrematic Belgium NV, Moorsel (BE)

(72) Inventors: Mauro Lorenzani, Malnate (IT); Juan Jorge Lloret Madrid, Noventa Padovana (IT); Frederic Bostyn, Moorsel (BE)

(73) Assignee: ENTREMATIC BELGIUM NV, Moorsel (BE)

( * ) Notice: Subject to any disclaimer, the term of this patent is extended or adjusted under 35 U.S.C. 154(b) by 205 days.

(21) Appl. No.: 15/540,390

(22) PCT Filed: Jan. 12, 2016

(86) PCT No.: PCT/EP2016/050450

§ 371 (c)(1),
(2) Date: Jun. 28, 2017

(87) PCT Pub. No.: WO2016/116325

PCT Pub. Date: Jul. 28, 2016

(65) Prior Publication Data

US 2017/0370143 A1 Dec. 28, 2017

(30) Foreign Application Priority Data

Jan. 21, 2015 (SE) ..... 1550051

(51) Int. Cl.
*E05F 15/40* (2015.01)
*E06B 9/08* (2006.01)
(Continued)

(52) U.S. Cl.
CPC ..... *E05F 15/40* (2015.01); *E05F 15/70* (2015.01); *E06B 9/08* (2013.01); *E06B 9/68* (2013.01);
(Continued)

(58) Field of Classification Search
CPC .. E05F 15/40; E05F 15/70; E06B 9/68; E06B 9/08; E06B 2009/6872; E06B 2009/6818;
(Continued)

(56) References Cited

U.S. PATENT DOCUMENTS 4,452,292 A * 6/1984 Leivenzon ..... E06B 9/70 160/133
5,198,974 A * 3/1993 Orsat ..... E06B 9/70 160/133
(Continued)

FOREIGN PATENT DOCUMENTS

CN 102409920 4/2012
EA 011398 2/2009
(Continued)

OTHER PUBLICATIONS

Office Action mailed in priority Swedish application 1550051-5 dated Jul. 29, 2015, 4 pages.
(Continued)

*Primary Examiner* — Daniel J Troy
*Assistant Examiner* — Timothy M Ayres
(74) *Attorney, Agent, or Firm* — Wissing Miller LLP

(57) ABSTRACT

The present invention concerns a motorized door for closing an area (3) at least partially defined by a frame, said Motorized door comprising: (A) a motorized driving mechanism (10) for moving a shutter between an open position (z=1) and a closed position (z=0) in a first direction (α) to close said area defined within said frame and in a second direction (β) to open said area; (B) a detection cell (5, 6) suitable for detecting an accidental event (e1), during the motion of the shutter. The motorized door further comprises a processing unit programmed to trigger a wind related safety function avoiding the yo-yo effect in case strong winds triggered the erroneous detection of an accidental
(Continued)

event by the detection cell, said wind related safety function comprising the following steps: (C) a processing unit (CPU): (a) stop the movement of the shutter in the first direction (α), and reverse said movement into the second direction (β) and, after a brief reverse time, Δt, of the order of 0.8 to 3.0 s, (b) stop said movement in the second direction (β) and reverse the movement back into the first direction (α) towards the closed position (z=0) of the shutter.

12 Claims, 5 Drawing Sheets

(51) Int. Cl.
*E06B 9/68* (2006.01)
*E05F 15/70* (2015.01)

(52) U.S. Cl.
CPC ..... *E05Y 2400/30* (2013.01); *E05Y 2400/456* (2013.01); *E05Y 2400/504* (2013.01); *E05Y 2900/10* (2013.01); *E05Y 2900/106* (2013.01); *E06B 2009/6818* (2013.01); *E06B 2009/6872* (2013.01)

(58) Field of Classification Search
CPC ..... E06B 2009/106; E05Y 2400/30; E05Y 2400/456; E05Y 2400/504; E05Y 2900/10
USPC ..... 160/104
See application file for complete search history.

(56) References Cited

U.S. PATENT DOCUMENTS

| | | | | |
|---|---|---|---|---|
| 5,526,865 | A | 6/1996 | Coenraets | |
| 6,230,785 | B1 | 5/2001 | Tokuyama et al. | |
| 6,388,412 | B1 | 5/2002 | Reed et al. | |
| 6,657,409 | B1 * | 12/2003 | Leivenzon | E06B 9/80 318/476 |
| 6,989,767 | B2 * | 1/2006 | Fitzgibbon | E06B 9/88 340/665 |
| 7,034,682 | B2 * | 4/2006 | Beggs | E06B 9/581 160/1 |
| 7,034,686 | B2 * | 4/2006 | Matsumura | H04L 67/36 340/572.1 |
| 8,109,317 | B2 * | 2/2012 | Bostyn | E06B 9/581 160/273.1 |
| 8,341,885 | B2 * | 1/2013 | Bostyn | E06B 9/11 49/26 |
| 8,360,132 | B2 * | 1/2013 | Drifka | E06B 9/13 160/194 |
| 2003/0210005 | A1 * | 11/2003 | Murray | E05F 15/41 318/286 |
| 2004/0239269 | A1 | 12/2004 | Fitzgibbon et al. | |
| 2007/0261305 | A1 * | 11/2007 | Kraeutler | E06B 9/13 49/27 |
| 2008/0224642 | A1 * | 9/2008 | Rodriguez | E05F 15/668 318/466 |
| 2010/0181033 | A1 | 7/2010 | Bostyn | |
| 2012/0073200 | A1 | 3/2012 | Bostyn | |
| 2017/0314319 | A1 * | 11/2017 | Bostyn | E05F 15/73 |
| 2018/0245401 | A1 * | 8/2018 | Van De Wiel | E06B 9/08 |

FOREIGN PATENT DOCUMENTS

| | | |
|---|---|---|
| EP | 0587586 | 3/1994 |
| EP | 1441100 | * 7/2004 |
| RU | 2306396 | 9/2007 |
| WO | 2008155292 | 12/2008 |

OTHER PUBLICATIONS

International Search Report mailed in PCT/EP2016/050450 dated Mar. 21, 2016, 4 pages.
International Search Report mailed in priority Swedish application 1550051-5 dated Jul. 29, 2015, 6 pages.
Chinese Search Report dated Aug. 21, 2018 in connection with corresponding Chinese Patent Application No. 201680006610.X, 2 pages.
Russian Search Report dated Feb. 26, 2019 in connection with corresponding Russian Patent Application No. 2017129237/12(050604), 3 pages.

* cited by examiner (a)

(b)

(a)

(b)

WIND SAFE DOOR

CROSS-REFERENCE TO RELATED APPLICATIONS

This application is the National Stage entry under 35 U.S.C. § 371 of International Application No. PCT/EP2016/050450 filed on Jan. 12, 2016, published on Jul. 28, 2016 under Publication Number WO 2016/116325, which claims the benefit of priority under 35 U.S.C. § 119 of Swedish Patent Application Number 1550051-5 filed Jan. 21, 2015.

TECHNICAL FIELD

The present invention concerns motorized doors comprising a shutter for closing or opening an area defined by a frame. In particular, it concerns motorized doors provided with detection cells suitable for detecting an accidental event during the closing of the shutter and thereupon stopping the motion of the shutter. The present invention proposes a solution to the problem of such doors exposed to strong winds or drafts, which can erroneously be interpreted by the detection cells as such an accidental event.

BACKGROUND OF THE INVENTION

Motorized doors comprising a shutter are commonly used to shut off openings, particularly in warehouses or industrial halls. These shutters are often made up of large flexible tarpaulins the lateral edges of which comprising beads which slide in guiding rails situated on each side of the opening that is to be closed. Alternatively, they can be made of rigid panels hinged to one another side by side or the shutter can be a rigid panel. Automatic doors are particularly useful when they are used to separate two rooms having different environmental conditions, such as temperature, relative humidity and the like, and more particularly to separate an indoor space from outdoor. Doors able to open and close at high speed are also known for these applications and are often referred to as "fast doors".

One issue with motorized doors, particularly with fast doors due to their high closing speed, is impacts with obstacles accidentally located within the closing trajectory of the shutter. Besides damaging the obstacle (which can be a human) such impact can damage the leading edge of the shutter and also disengage the bead of the shutter lateral edges from the guiding rail. Systems for automatically reinserting a bead thus disengaged are described e.g., in US20100181033, which disclosure is herein incorporated in its entirety by reference.

Since preventing is better than repairing, many motorized doors have been developed comprising (a) detection cells suitable for detecting an accidental event and (b) a control system programmed for implementing a safety function aimed at managing the accidental presence of obstacles, in particular by stopping the door in its travel when it encounters one and moving it away from the obstacle in order to allow the removal thereof.

Various types of detection cells for detecting an accidental event are known in the art. Contactless detection systems, i.e., enabling an obstacle to be detected before impact, are disclosed e.g., in U.S. Pat. No. 7,034,686 with a proximity detector provided with an antenna, which triggers a command to stop and reverses the closure of the vertical door when the magnetic field created by the antenna is disturbed by an foreign object. This system has the advantage of preventing an impact, but it has the drawback of lacking precision given that the magnetic field may radiate outside the closure plane and thus cause false alarms triggered by objects situated close to the door but not underneath it. Optical sensors are also available which are able to detect the presence of a foreign body within the trajectory of the shutter.

An accidental event detection cell can comprise contact detectors as disclosed for example in US2007/0261305. Alternatively, some detection cells are based on the comparison with a reference value of parameters such as the motor torque, motor energy consumption, or shutter closing speed, such as in U.S. Pat. No. 5,198,974. A person skilled in the art therefore has a selection of detection cells to choose from for detecting an accidental event. The safety of a door requires, however, that a safety function be triggered upon detection of an accidental event. In particular, such safety function always includes stopping the closing motion of the shutter and often comprises reversing the direction of the motion to open the shutter, with variations as up to which re-opening position the shutter should be re-opened, whether or not the shutter should be closed again after reaching its re-opening position, the re-opening and/or re-closing speeds of the shutter, and the like.

U.S. Pat. Nos. 7,034,682, 6,989,767, 5,198,974 and US2007/0261305 concern safety systems for doors in which, as soon as an accidental event is detected, the motor stops, reverses its direction of rotation in order to open the door completely and stops definitively when the door is completely open. The door can be closed once again by manual intervention.

U.S. Pat. No. 4,452,292 concerns a door control system wherein an unwanted opening or closing of a shutter which has been previously locked is identified by a detection cell measuring an increase of the motor energy consumption. As illustrated in FIG. 2(*b*), mixed line, a control system stops the movement of the shutter for a period of time, after which the initial movement is resumed. In case a higher energy consumption is detected again, the shutter is stopped again for a given period of time. This control system is not suitable for protecting neither the shutter nor an obstacle, since absent a reversal of the movement in the opening direction, it is difficult or, in some cases, even impossible to remove such obstacle.

US20120073200 discloses a control system triggering a safety function upon detection of an accidental event comprising, as illustrated in FIG. 2(*b*), dashed line; the steps of (a) stopping the motion of the shutter and storing the position of impact, (b) reversing the movement and opening the shutter up to a waiting position, (c) after a predetermined period of time, reversing the movement again to close the shutter at a first speed, V1, until the shutter reaches a position located at a predetermined distance upstream from the stored position of impact, at which point (d) the closing speed is reduced to V3<V1, until the shutter passes by and proceeds beyond the position of impact at which point absent a new impact at said position, (e) the closing velocity is increased back to V1.

None of the known detection cells and control systems is able to identify the nature of an accidental event. For example, strong winds may apply a force onto the shutter of the door which increases the friction forces between the edges of the shutter and guiding rails to a point where the detection cells send a signal to the control system, which may be wrongly interpreted as an accidental event requiring the triggering of a safety function. The shutter is then stopped, its motion reversed to re-open the shutter, and reversed again to close it again. If the wind keeps blowing, the same signal can be sent again by the detection cells and, again, be wrongly interpreted by the control system which would trigger the safety function again, thus initiating a sequence referred to in the art as a "yo-yo" effect, which is of course undesirable. Keeping the shutter in its open position is, of course, not an acceptable solution, since the shutter is there to protect the interior of a room from inter alia external winds.

There therefore remains a need in the art for a safety door provided with detection cells and control system, which is potentially exposed to winds and can nonetheless be closed even in case of strong winds blowing. The present invention provides a wind-safe motorized door capable of automatically closing a shutter even when exposed to strong winds and thus avoiding the yo-yo effect. This and other advantages of the present invention are presented in continuation.

SUMMARY OF THE INVENTION

The present invention is defined in the appended independent claims. Preferred embodiments are defined in the dependent claims. In particular, the present invention concerns a motorized door for closing an area at least partially defined by a frame, said motorized door comprising:

(A) a motorized driving mechanism suitable for moving a leading edge of a shutter between an open position (z=1) and a closed position (z=0) in a first direction (α) to close said area defined within said frame and in a second direction (β) to open said area;

(B) a detection cell suitable for detecting an accidental event (eI), wherein I∈ℕ, during a moving of the leading edge of the shutter in the first direction (α) to close said area, said accidental event being a potential threat to a good functioning of the motorized door, (C) a processing unit (CPU) programmed to trigger the following operations upon reception of a signal from the detection cell that an accidental event has occurred, during the moving in the first direction (α) of the shutter from the open position (z=1) towards the closed position (z=0):

(a) define I=0 at t=0, wherein I is the number of accidental events (eI) detected by the detection cell during the moving of the leading edge of the shutter in the first direction (α) to close said area, and t=0 defines the time the shutter starts moving from the open position (z=1);

(b) in case of a detection of an $(M+i)^{th}$ accidental event (e(M+i)), wherein M∈ℕ, i∈ℕ, and i>0, memorize the number of accidental events, I=(M+i), and (c) stop the movement of the leading edge in the first direction (α), and reverse said movement into the second direction (β); and (i) if the number of accidental events, I=(M+N), wherein N is a predefined number of wind-like repetitions, continue the movement into the second direction (β) until the leading edge reaches its open position (z=1) and keep the shutter in the open position; or (ii) if the number of accidental events, I<(M+N), after a brief reverse time, Δt, stop said movement in the second direction (β) and reverse the movement back into the first direction (α) towards the closed position (z=0) of the shutter;

(d) after step (c)(ii), in case an $(M+i+1)^{th}$ accidental event (e(M+i+1)) is detected during the movement of the leading edge into the first direction (α), memorize the number of accidental events, I=M+i+1, and repeat step (c)

In order to not start the step (c)(ii) at the first accidental event, it is preferred that in case an $m^{th}$ accidental event is detected between steps (a)&(b), with 0<m≤M, wherein M is preferably equal to 0, 1, 2, or 3, the processor triggers the following steps:

memorize the number of accidental events, I=m, and stop the movement of the leading edge in the first direction (α), and reverse said movement into the second direction (β); until the leading edge reaches a predetermined stop position ($z_{stop}$), located between the position of the $m^{th}$ accidental event and the open position (z=1), included, and reverse the movement back into the first direction (α) towards the closed position (β) of the shutter.

The brief reverse time, Δt, is very short and it is preferably not more than 3 s, more preferably not more than 1 s, most preferably not more than 800 ms.

The detection cell is suitable for detecting an accidental event, but it is the processing unit (CPU) that determines whether an event detected by the detection cell should be considered or not as an accidental event (eI) triggering the operation defined supra. This is carried out by the CPU by comparing the value of a parameter measured or detected by the detection cell with a predetermined reference value or reference range of said parameter. The detection cell is preferably selected among one or more of the following:

(a) A cell suitable for detecting on the shutter a force applied transverse to a main surface of said shutter;

(b) A cell suitable for detecting an increase in power or energy consumption required by a motor driving the motion of the shutter;

(c) A cell suitable for measuring a torque of the motorized driving mechanism, (d) A cell suitable for measuring the velocity of the movement of the leading edge of the shutter;

(e) A cell suitable for measuring the acceleration of the movement of the leading edge of the shutter; or (f) A cell suitable for detecting a stopping of the movement of the leading edge of the shutter;

The predefined number of accidental events, M+N, defines when the operations stop and the door is opened as the system considers that it cannot be closed in safe conditions. M+N is preferably not more than 20, preferably not more than 15, more preferably not more than 10. The predefined number of wind-like accidental events, N, is not more than 18, preferably not more than 13, more preferably not more than 8.

The shutter is preferably of the type comprising two lateral edges engaged in parallel guiding rails defining two sides of the frame, and wherein the leading edge links the two lateral edges, and moves along the direction defined by the guiding rails upon closing and opening the shutter. The motorized door preferably further comprises means for monitoring the instantaneous position and/or velocity of the leading edge of the shutter in its closing/opening trajectory in the direction defined by the guiding rails. Such means for monitoring the instantaneous position and/or velocity of the leading edge of the shutter may be selected among the following:

Optical device suitable for counting a number of windows aligned at regular intervals along at least one lateral edge of the shutter; or Optical device for measuring the time difference between two successive windows;

Device for counting the number of revolution of the motor driving the opening/closing of the shutter.

In a preferred embodiment of the present invention at least one lateral edge of the shutter comprises a bead or a series of adjacent teeth, slideably engaged in an opening of the corresponding guiding rail and which can be extracted therefrom under the action of a defined pulling force directed transversely to the guiding rail provoked for example by an impact upon closing the shutter, and wherein:

the motorized door further comprises a means for reinserting into the guiding rail opening the bead series of adjacent teeth that has been extracted therefrom, this means comprising a guide member which is positioned facing the guiding rail opening and which is designed so that, while the shutter is being opened, it deflects toward the guiding rail opening the bead or series of adjacent teeth that has been extracted from this guiding rail opening, wherein the guide member comprises at least one pair of rollers having fixed axes of rotation which are located symmetrically on each side of the mid-plane of the shutter, in the same plane substantially perpendicular to said mid-plane of the shutter and are directed obliquely with respect to said mid-plane of the shutter so that the rollers converge toward the bottom of the guiding rail opening and roll, as the shutter is moved in the opening direction, along the bead which has been extracted from the guiding rail opening, pushing it into the guiding rail opening.

The present invention is suitable for various types of doors. For example the shutter and motorized driving mechanism may be selected from:

(a) a flexible shutter wherein the motorized driving mechanism (10) drives the rotation of a drum (11) to move the leading edge (1L) in the first direction (a) to close the area by unwinding the flexible shutter from said drum, and to move it in the second direction (β) to open said area by winding the flexible shutter about said drum;

(b) deformable shutter comprising panels (1*p*) hinged to one another parallel to the leading edge (1L), wherein the motorized driving mechanism (10) drives the rotation of an axle about which the hinged panels rotate and change direction, or (c) a rigid shutter, wherein the motorized driving mechanism (10) drives the rotation of an axle which moves the rigid shutter in the plane of said area in the first and second directions, preferably by means of a gear system; cables, or chains.

BRIEF DESCRIPTION OF THE FIGURES

For a fuller understanding of the nature of the present invention, reference is made to the following detailed description taken in conjunction with the accompanying drawings in which.

DETAILED DESCRIPTION OF THE INVENTION

Figure 1:
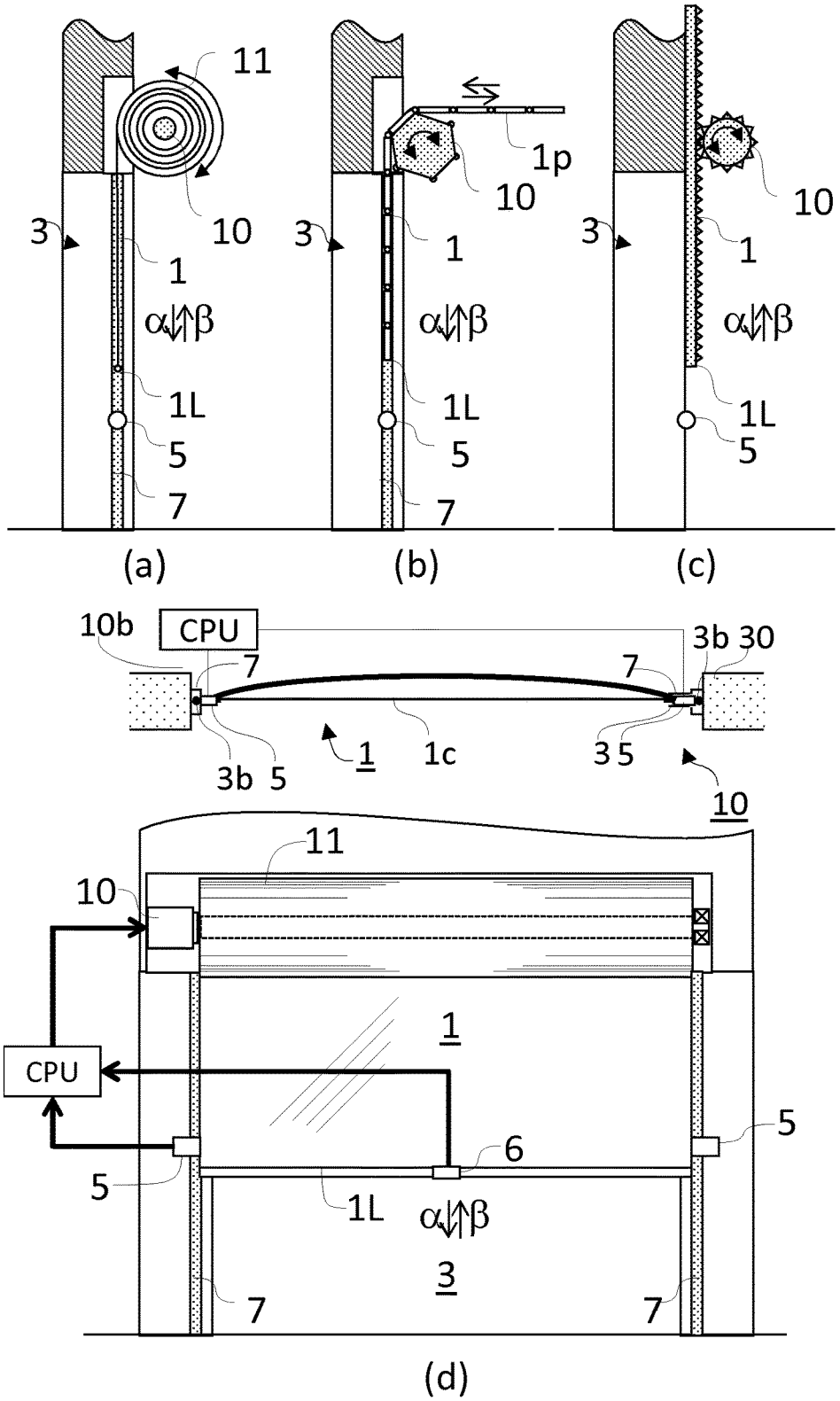
FIG. 1: shows three embodiments of motorized doors according to the present invention.

As illustrated in FIG. 1, a motorized door according to the present invention comprises a motorized driving mechanism (10) suitable for moving a leading edge (1L) of a shutter (1) in a first direction (α) to close said area defined within said frame and in a second direction (β) to open said area.

As shown in FIGS. 1(*a*)&(*d*) the shutter can be a flexible shutter in the form of a flexible fabric or curtain, and the motorized driving mechanism (10) drives the rotation of a drum (11) to move the leading edge (1L) in the first direction (α) to close the area by unwinding the flexible shutter from said drum, and to move it in the second direction (β) to open said area by winding the flexible shutter about said drum.

FIG. 1(*b*) illustrates a deformable shutter comprising rigid panels (1*p*) hinged to one another parallel to the leading edge (1L), wherein the motorized driving mechanism (10) drives the rotation of an axle about which the hinged panels rotate and change direction. For example, notches in the axle may cooperate with the hinges between panels to ensure a slip-free movement of the deformable shutter. Alternatively, cables or chains can be used to drive the movement of the shutter.

FIG. 1(*c*) shows a third type of shutter in the form of a rigid shutter, wherein the motorized driving mechanism (10) drives the rotation of an axle which moves the rigid shutter in the plane of said area in the first and second directions. A gear system is illustrated in FIG. 1(*c*), but any means known to a person skilled in the art for moving up and down a rigid shutter, such as cables or chains can be used without affecting the present invention.

A shutter is a surface defined by a leading edge (1L) moving up (β) and down (α), in case of a vertical area (3) as illustrated in FIG. 1, said leading edge bridging two lateral edges parallel to one another. Regardless of the type of shutter used, the lateral edges are preferably engaged in guiding rails (7) suitable for guiding the shutter in its trajectory when opening or closing the area (3). An example of an automatic door comprising lateral edges of a shutter coupled to guiding rails is given e.g., in EP0587586 or WO2008155292, the contents of which are herein incorporated by reference.

A motorized door according to the present invention must also comprise a detection cell (5, 6) suitable for detecting an accidental event (eI), wherein $I \in \mathbb{N}$, during a moving of the leading edge of the shutter in the first direction (a) to close said area. An accidental event is defined as being a potential threat to a good functioning of the motorized door. As discussed in the introduction, many detection cells (5, 6) are available in the art and the selection of one or the other does not affect the present invention as long as gusts of wind hitting the surface of the shutter may trigger a signal from such detection cells. A door according to the present invention must therefore comprise at least one such detection cell which can mistake wind blowing against the surface of the shutter as an accidental event. In particular, it comprises any detection cell capable of:

(a) detecting a force on the lateral edges of the shutter; these comprise for example a dynamometer coupled to the edge of the shutter and running along the guiding rail; or (b) detecting an increase in power or energy consumption required by a motor driving the motion of the shutter due to the increased friction forces between the lateral edges of the shutter and the guiding rail as the wind blows against the shutter main surface; or (c) measuring a torque of the motorized driving mechanism, which may increase for the same reason as in (b); or (d) measuring the velocity of the movement of the leading edge of the shutter which may decrease because of a raise in the friction forces; or (e) measuring the acceleration of the movement of the leading edge of the shutter which may vary as a function of the magnitude of the friction forces; or (f) detecting a stopping of the movement of the leading edge of the shutter, when the friction forces are higher than the limiting power of the motorized mechanism.

Figure 3:
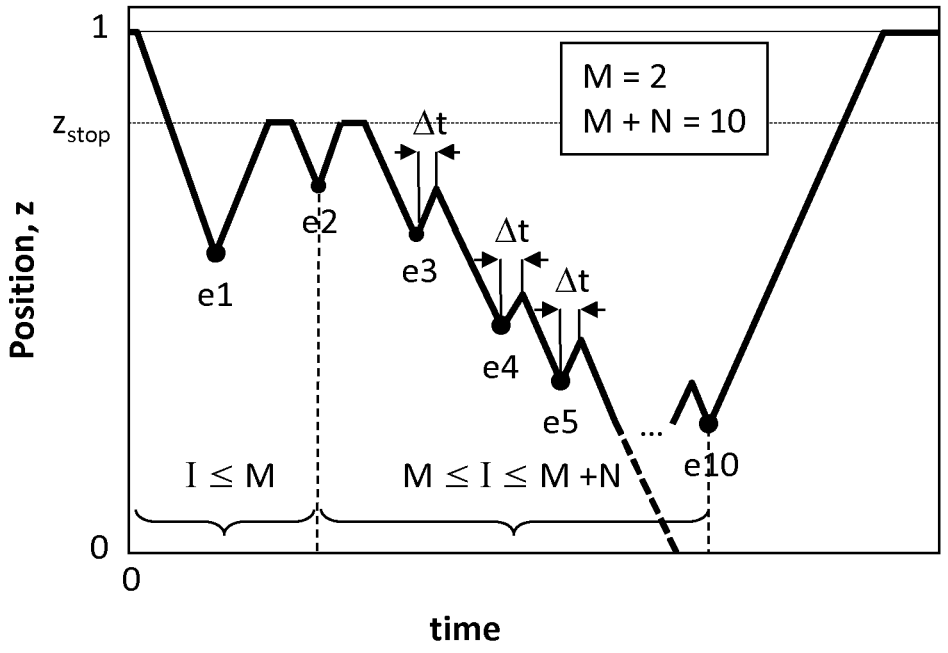
FIG. 3: shows the shutter position as a function of time in case of a number of accidental events detected by detection cells and the safety function thus triggered (a) according to an alternative embodiment of the present invention with M=2 and (M+N)=10; and (b) according to yet an alternative embodiment with M=0 and N=8.
Figure 3:
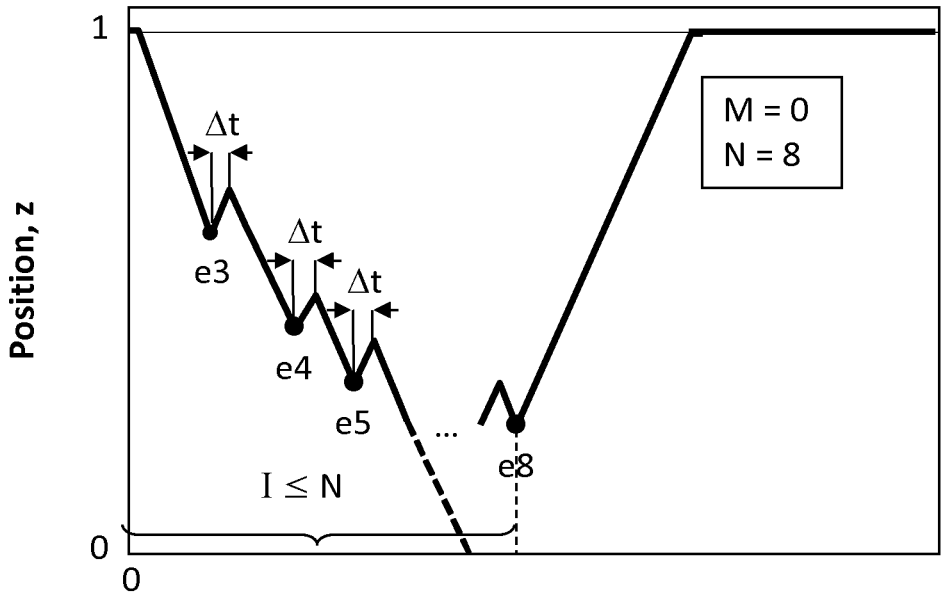
Figure 4:
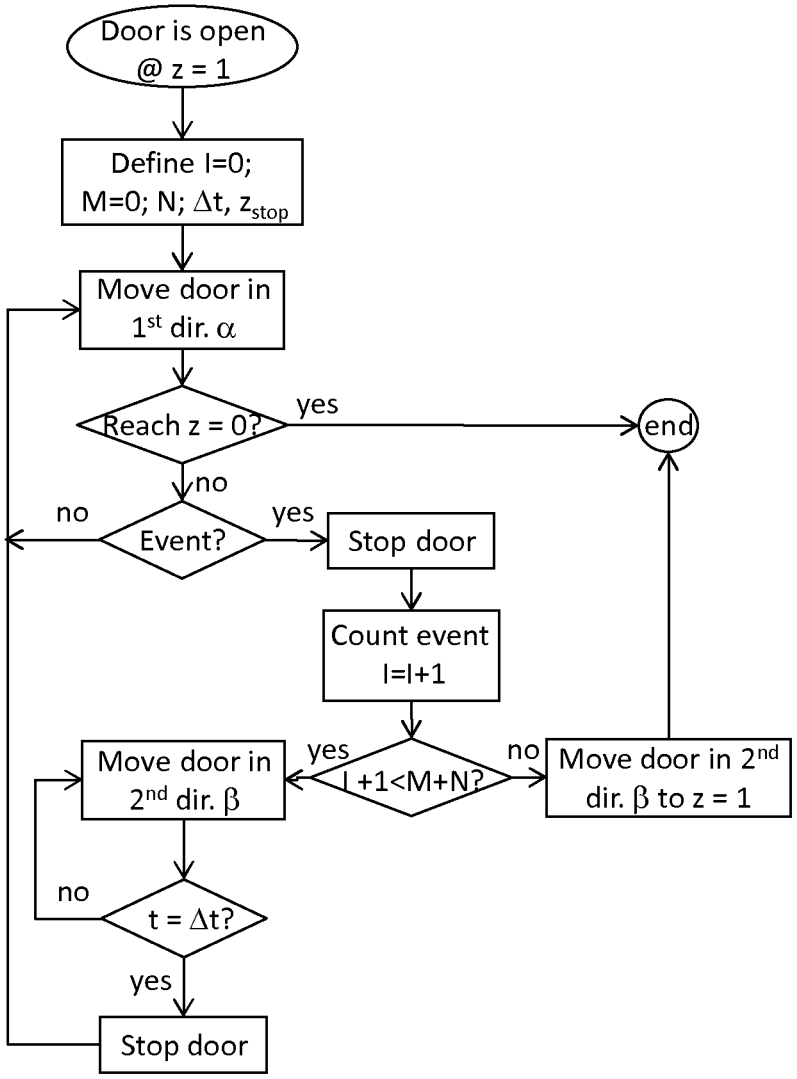
FIG. 4: shows a flowchart illustrating a safety function according to an embodiment of the present invention.

The gist of the present invention is the control system, driven by a processing unit (CPU) which, upon reception of a signal from the detection cell that an accidental event may have occurred during the closing of the shutter in the first direction, α, triggers the following wind related function as illustrated in the graph of FIG. 3(*b*) and in the flowchart of FIG. 4:

(a) Define I=0 at t=0, wherein I is the number of accidental events (eI) detected by the detection cell during the moving of the leading edge of the shutter in the first direction (α) to close said area, and t=0 defines the time the shutter starts moving from the open position (z=1);

(b) in case of a detection of an $(M+i)^{th}$ accidental event (e(M+i)), wherein $M \in \mathbb{N}$, $i \in \mathbb{N}$, and i>0, memorize the number of accidental events, I=(M+i), and (c) stop the movement of the leading edge in the first direction (α), and reverse said movement into the second direction (β); and (i) if the number of accidental events, I=(M+N), wherein N is a predefined number of wind-related events, continue the movement into the second direction (β) until the leading edge reaches its open position (z=1) and keep the shutter in the open position; or (ii) if the number of accidental events, I<(M+N), after a brief reverse time, Δt, stop said movement in the second direction (β) and reverse the movement back into the first direction (α) towards the closed position (z=0) of the shutter.

After step (c)(ii), in case an $(M+i+1)^{th}$ accidental event (e(M+i+1)) is detected during the movement of the leading edge into the first direction (α), memorize the number of accidental events, I=M+i+1, and repeat step (c) with the new value of I.

For any $I^{th}$ accidental event with I≤M, the control system considers a priori that said accidental event is not wind related and is caused by an obstacle, an object, or a person obstructing the path of the shutter. A different safety function is then triggered, referred to as non-wind related safety function). The number, M, of non-wind related events is predefined by the operator and can typically be equal to 0, 1, 2, 3, or even more repetitions. It is preferred that M=2, as more than two accidental events occurring during a single closing operation are likely to be wind related.

Figure 2:
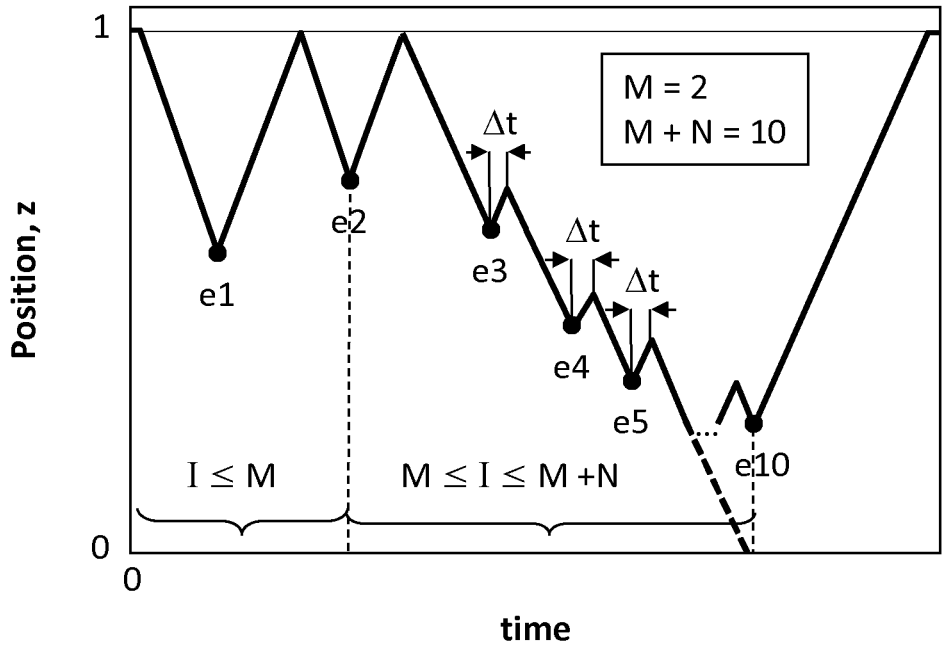
FIG. 2: shows the shutter position as a function of time in case of a number of accidental events detected by detection cells and the safety function thus triggered (a) according to one embodiment of the present invention with M=2 and (M+N)=10; and (b) according to the embodiment illustrated in (a) compared with prior art safety functions.
Figure 2:
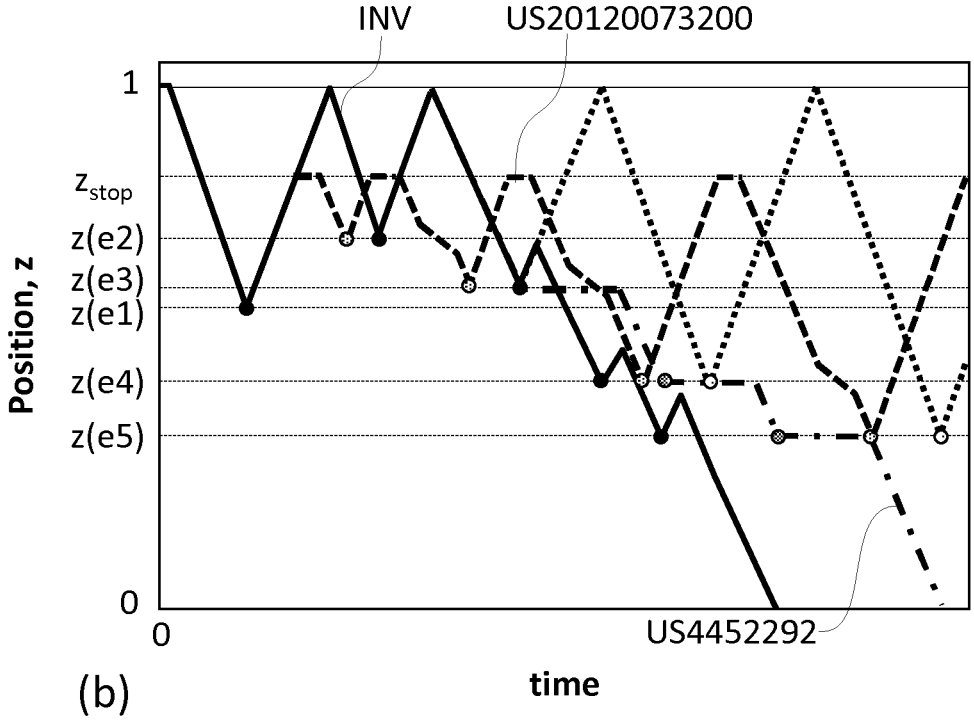

The non-wind related safety function triggered by the control system for any $I^{th}$ accidental event with I≤M detected by a detection cell may comprise the following steps as illustrated in FIGS. 2(*a*), 3(*a*) and 5:

memorize the number of accidental events, I=m, and stop the movement of the leading edge in the first direction (α), and reverse said movement into the second direction (β); until the leading edge reaches a predetermined stop position ($z_{stop}$), located between the position of the $m^{th}$ accidental event and the open position, z=1, included, and reverse the movement back into the first direction (α) towards the closed position (0) of the shutter.

The stop position, $z_{stop}$, can be the opening position, z=1 as illustrated in FIG. 2(*a*) or, as illustrated in FIG. 3(*a*), it can be a position different from z=1 but in any case upstream from the position of the accidental event, to allow an opportunity for removing the obstacle. The terms "upstream" and "downstream" of a position being defined with respect to the first direction, α, of moving of the shutter. A stop position, $z_{stop}$, different from z=1 is advantageous as it shortens the time sequence of re-opening the shutter, and closing it back. In a preferred embodiment, the non-wind related safety function can be as defined in US20120073200 which content is herein included by reference, with an opening to a stop position different from z=1, waiting for a predetermined time, closing of the shutter in the second direction, β, at a full speed, V1, until a short distance upstream from the position of the accidental event, whence it slows down to a reduced speed, V2<V1, as the shutter passes by said position. Absent a new event at the same position, the shutter proceeds in the second direction at full speed, V1. The safety function disclosed in US20120073200 is represented in FIG. 2(*b*) with dashed lines.

For any $I^{th}$ accidental event with M<I<M+N, wherein N is the predefined number of wind-related events, the control system considers that said accidental event is related to bursts of wind hitting the surface of the shutter. In order to prevent the yo-yo effect, the wind-related safety function defined by steps (a) to (c) discussed supra and illustrated in FIGS. 3(*b*) and 4 is applied. If M is defined as M=0 (cf. FIGS. 3(*b*) and 4), the wind related safety function is implemented upon detection of a first accidental event (e1).

As defined in step (c)(ii), the reversed movement in the second direction, β, following an $(M+i)^{th}$ accidental event is stopped after a brief reverse time, Δt, and the shutter is moved back into the first direction (α) towards the closed position (z=0). The reversed time, Δt, is preferably quite brief, so that the interruption in the closing operation of the shutter can be as brief as possible. For example, the brief reverse time, Δt, can be not more than 3 s, preferably not more than 1 s, more preferably not more than 800 ms.

The efficacy of the wind-safe door is compared in FIG. 2(*b*) with doors of the prior art in case of strong winds causing several signals sent by the detection cell and erroneously interpreted by the processing unit as an accidental event (eI). The solid line corresponds to the embodiment of the present invention illustrated in FIG. 2(*a*), with M=2 and (M+N)=10. For the first two events, e1, e2 (M=2) identified by the detection cell, a non-wind related safety function is triggered which is comparable with any of the prior art safety functions. In FIG. 2(*a*), it consists of opening the shutter to its open position, z=1, followed by closing the shutter until a new accidental event is detected; in FIG. 3(*a*) the shutter is opened to a stop position, $z_{stop}$, located downstream from the open position, z=1. For the third and following events, e3 to e(M+N), the wind related safety function is triggered, with a brief movement reversal prior to resuming the closing of the shutter. The wind related safety function proceeds until the shutter reaches the closed position, z=0, or until an $(M+N)^{th}$ event (e10) is detected, at which point the shutter is opened to its open position, z=1, and the safety function ended. The predefined number of accidental events, M+N, is preferably not more than 20, preferably not more than 15, more preferably not more than 10. The predefined number of wind-related accidental events, N, is preferably not more than 18, preferably not more than 13, more preferably not more than 8.

A safety function according to the prior art with opening of the shutter up to the open position, z=1, followed by closing again the shutter until a next event is identified, is illustrated with dotted lines in FIG. 2(*b*). This kind of safety function provokes a typical yo-yo effect in case wind interferes with the detection cell. The safety function proposed in US20120073200 is illustrated with dashed lines in FIG. 2(*b*). The yo-yo effect is attenuated because the shutter stops at a stop position, $z_{stop}$, located downstream from the open position, z=1. The safety function defined in U.S. Pat. No. 4,452,292, although not designed for reducing the damages in case of impact with an obstacle, since it does not comprise any reversing movement allowing such obstacle to be removed from the trajectory of the shutter, is represented in FIG. 2(*b*) as a mixed line. Since said safety function is triggered by detection of an increase in current consumption during the closing (or rather opening) of the shutter, it could be triggered by gusts of wind blowing against a main surface of the shutter. The wind related safety function of the present invention is advantageous over the one disclosed in U.S. Pat. No. 4,452,292, in that though brief, the reversal of the shutter motion into the second direction, β, allows the force applied by a constant wind onto a main surface of the shutter to decrease as the exposed area of said main surface is decreased accordingly. The closing movement can thus be resumed more rapidly than if the area and therefore the force applied onto the main surface of the shutter remains constant.

The shutter preferably comprises two lateral edges engaged in parallel guiding rails (7) defining two sides of the frame, and wherein the leading edge links the two lateral edges, and moves along the direction defined by the guiding rails upon closing and opening the shutter. The motorized door preferably further comprises means for monitoring the instantaneous position, z, of the leading edge of the shutter in its closing/opening trajectory in the direction defined by the guiding rails (7).

The means for monitoring the instantaneous position and/or velocity of the leading edge of the shutter can be selected among the following:

- Optical device suitable for counting a number of windows aligned at regular intervals along at least one lateral edge of the shutter; or
- Optical device for measuring the time difference between two successive windows;
- Device for counting the number of revolution of the motor driving the opening/closing of the shutter.

A motorized door according to the present invention may comprise the following features:

- at least one lateral edge of the shutter comprises a bead or a series of adjacent teeth, slidingly engaged in an opening of the corresponding guiding rail (7) and which can be extracted therefrom under the action of a defined pulling force directed transversely to the guiding rail provoked for example by an impact upon closing the shutter or by a burst of wind against a main surface of the shutter, and wherein:
- the motorized door further comprises a means for reinserting into the guiding rail opening the bead series of adjacent teeth that has been extracted therefrom, this means comprising a guide member which is positioned facing the guiding rail opening and which is designed so that, while the shutter is being opened, it deflects toward the guiding rail opening the bead or series of adjacent teeth that has been extracted from this guiding rail opening, wherein the guide member comprises at least one pair of rollers having fixed axes of rotation which are located symmetrically on each side of the mid-plane of the shutter, in the same plane substantially perpendicular to said mid-plane of the shutter and are directed obliquely with respect to said mid-plane of the shutter so that the rollers converge toward the bottom of the guiding rail opening and roll, as the shutter is moved in the opening direction, along the bead which has been extracted from the guiding rail opening, pushing it into the guiding rail opening.

Figure 5:
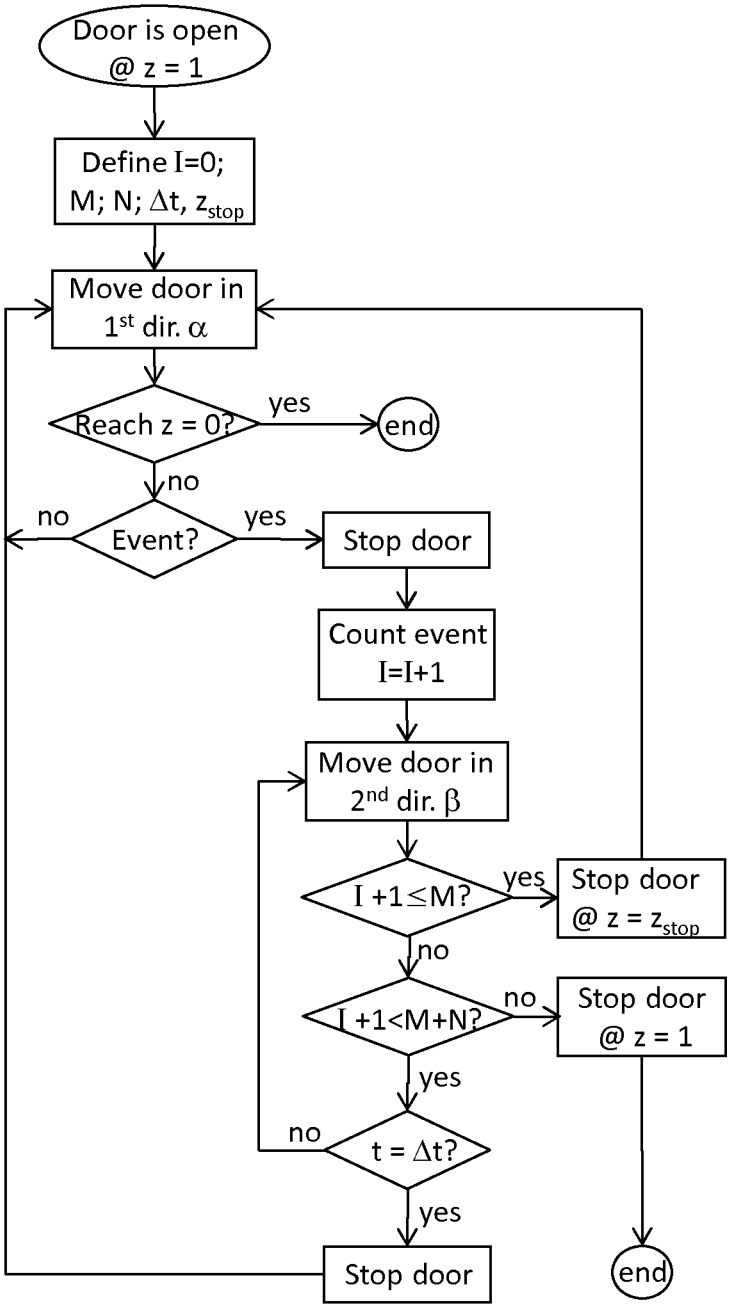
FIG. 5: shows a flowchart illustrating a safety function according to another embodiment of the present invention.

FIG. 5 shows a flowchart of a preferred embodiment of the safety function, wherein upon detecting an accidental event (eI) the door is stopped and the movement of the shutter is reversed into the second direction, β. The number of events is stored as an additional event, I+1.

If I+1≤M, the movement of the shutter in the second direction, β, is stopped at the stop position, $z_{stop}$, The stop position, $z_{stop}$, can be equal to the open position, z=1 as illustrated in FIG. 2(*a*), or it can be located downstream from the open position, as illustrated in FIG. 3(*a*). The shutter can remain at the stop position for a short time before reversing the movement back into the first direction, α, or the movement reversal may happen immediately after stopping the shutter. The shutter proceeds its closing trajectory until a further accidental event is detected. If no such accidental event is detected, the shutter may proceed until it reaches its closed position, z=0. Else, the non-wind related function is repeated with I=I+i until I+i=M.

If M<I+1<M+N, the processing unit triggers the wind related safety function, comprising stopping the movement in the second direction, β, of the shutter after a brief reverse time, Δt, of the order of 0.8 to about 3.0 s, to give time to the wind generated stress to decrease sufficiently to allow the movement of the shutter to be reversed back into the first direction, α, of closure. If no further accidental event occurs, the shutter is allowed to proceed its trajectory until it reaches its closed position, z=0. If a further accidental event is detected the wind related safety function is resumed with I=I+i until I+i=(M+N)−1.

If I+1=M+N, the processing unit considers that the shutter cannot be closed in good conditions, and the shutter is opened to its open position, z=1 and the safety process is ended.

The flowchart of FIG. 4 is a special embodiment of the flowchart of FIG. 5, wherein M is defined as M=0, corresponding to the embodiment illustrated in FIG. 3(*b*), with the wind related safety function being triggered upon detection of a first accidental event, e1.

The wind related safety function applied at a first accidental event or, preferably, at (M+1) accidental events and following, with the first M accidental events being handled as non-wind related events as known in the art is very advantageous to avoid the yo-yo effect observed with doors exposed to strong winds or to wind bursts. The yo-yo effect is highly undesirable, as it consumes much motor energy while leaving the indoor volume exposed to the outdoor environmental conditions. The limiting number of accidental events (M+N) after which the shutter is moved back to its open position, z=1 and the safety function is ended corresponds to a situation wherein it is considered that the shutter cannot be closed in safe conditions, and it is safer to let it open.

| REF | DESCRIPTION |
|---|---|
| 1 | shutter |
| 1L | leading edge of shutter |
| 3 | area to be closed and opened |
| 5 | detection cell |
| 6 | detection cell |
| 7 | guiding rail |
| 10 | motorized driving mechanism |
| 11 | rotating drum |
| α | first direction of leading edge displacement to close the area |
| β | second direction of leading edge displacement to open the area |
| Δt | brief reverse time |
| eI | $I^{th}$ accidental event |
| M | initial number of non-wind related accidental events |
| N | number wind-related accidental events |
| M + N | total number of accidental events before the shutter is permanently opened |
| z (ei) | position where accidental event (ei) occurred |
| $z_{stop}$ | shutter stopping position upon reversal after the first M events |

The invention claimed is:

1. A motorized door for closing an area at least partially defined by a frame, said motorized door comprising:

(A) a motorized driving mechanism suitable for moving a leading edge of a shutter between an open position (z=1) and a closed position (z=0) in a first direction (a) to close said area defined within said frame and in a second direction (β) to open said area;

(B) a detection cell suitable for detecting an accidental event (eI), wherein I∈ℕ, during a moving of the leading edge of the shutter in the first direction (a) to close said area, said accidental event a potential threat to a good functioning of the motorized door, (C) a processing unit programmed to trigger the following operations upon reception of a signal from the detection cell that an accidental event has occurred, during the moving in the first direction (α) of the shutter from the open position (z=1) towards the closed position (z=0):

(a) define I=0 at t=0, wherein I is the number of accidental events (eI) detected by the detection cell during the moving of the leading edge of the shutter in the first direction (α) to close said area, and t=0 defines the time the shutter starts moving from the open position (z=1);

(b) in case of a detection of an $(M+i)^{th}$ accidental event (e(M+i)), wherein M∈ℕ, i∈ℕ, and i>0, memorize the number of accidental events, I=(M+i), and (c) stop the movement of the leading edge in the first direction (α), and reverse said movement into the second direction (β); and (i) if the number of accidental events, I=(M+N), wherein N is a predefined number of wind-related events and wherein N>0, continue the movement into the second direction (β) until the leading edge reaches its open position (z=1) and keep the shutter in the open position; or (ii) if the number of accidental events, I<(M+N), after a brief reverse time, Δt, stop said movement in the second direction (β) and reverse the movement back into the first direction (α) towards the closed position (z=0) of the shutter; and (d) after step (c)(ii), in case an $(M+i+1)^{th}$ accidental event (e(M+i+1)) is detected during the movement of the leading edge into the first direction (α), memorize the number of accidental events, I=M+i+1 and repeat step (c).

2. A motorized door according to claim 1, wherein in case an $m^{th}$ accidental event is detected between steps (a) & (b), with 0<m≤M, the processor triggers the following steps:

memorize the number of accidental events, I=m, and stop the movement of the leading edge in the first direction (α), and reverse said movement into the second direction (β); until the leading edge reaches a predetermined stop position ($z_{stop}$), located between the position of the $m^{th}$ accidental event and the open position (z=1), included, and reverse the movement back into the first direction (α) towards the closed position (Z=0) of the shutter.

3. A motorized door according to claim 1, wherein M=0, 1, 2, or 3.

4. A motorized door according to claim 1, wherein the brief reverse time, Δt, is not more than 3 s.

5. A motorized door according to claim 1, wherein the processing unit determines that an accidental event (eI) occurred by comparing with a predetermined reference value or reference range the value of a parameter measured or detected by the detection cell, said detection cell being selected among one or more of the following:

(a) a cell suitable for detecting on the shutter a force applied transverse to a main surface of said shutter;

(b) a cell suitable for detecting an increase in power or energy consumption required by a motor driving the motion of the shutter;

(c) a cell suitable for measuring a torque of the motorized driving mechanism, (d) a cell suitable for measuring the velocity of the movement of the leading edge of the shutter;

(e) a cell suitable for measuring the acceleration of the movement of the leading edge of the shutter; or (f) a cell suitable for detecting a stopping of the movement of the leading edge of the shutter.

6. A motorized door according to claim 1, wherein the predefined number of accidental events, M+N, is not more than 20 or wherein the predefined number of wind-related events, N, is not more than 18.

7. A motorized door according to claim 1, wherein the shutter comprises two lateral edges engaged in parallel guiding rails defining two sides of the frame, and wherein the leading edge links the two lateral edges, and moves along the direction defined by the guiding rails upon closing and opening the shutter.

8. A motorized door according to claim 7, further comprising means for monitoring the instantaneous position or velocity of the leading edge of the shutter in its closing/opening trajectory in the direction defined by the guiding rails.

9. A motorized door according to claim 8, wherein the means for monitoring the instantaneous position or velocity of the leading edge of the shutter are selected among the following:

an optical device suitable for counting a number of windows aligned at regular intervals along at least one lateral edge of the shutter;

an optical device for measuring the time difference between two successive windows; or a device for counting the number of revolution of the motor driving the opening/closing of the shutter.

10. A motorized door according to claim 7, wherein, at least one lateral edge of the shutter comprises a bead or a series of adjacent teeth, slideably engaged in an opening of the corresponding guiding rail and which can be extracted therefrom under the action of a defined pulling force directed transversely to the guiding rail provoked for example by an impact upon closing the shutter, and wherein:

the motorized door further comprises a means for reinserting into the guiding rail opening the bead series or adjacent teeth that has been extracted therefrom, this means comprising a guide member which is positioned facing the guiding rail opening and which is designed so that, while the shutter is being opened, it deflects toward the guiding rail opening the bead or series of adjacent teeth that has been extracted from this guiding rail opening, wherein the guide member comprises at least one pair of rollers having fixed axes of rotation which are located symmetrically on each side of the mid-plane of the shutter, in the same plane substantially perpendicular to said mid-plane of the shutter and are directed obliquely with respect to said mid-plane of the shutter so that the rollers converge toward the bottom of the guiding rail opening and roll, as the shutter is moved in the opening direction, along the bead which has been extracted from the guiding rail opening, pushing it into the guiding rail opening.

11. A motorized door according to claim 1, wherein the shutter and motorized driving mechanism are selected from:

(a) a flexible shutter wherein the motorized driving mechanism drives the rotation of a drum to move the leading edge in the first direction ($\alpha$) to close the area by unwinding the flexible shutter from said drum, and to move it in the second direction ($\beta$) to open said area by winding the flexible shutter about said drum;

(b) a deformable shutter comprising panels hinged to one another parallel to the leading edge, wherein the motorized driving mechanism drives the rotation of an axle about which the hinged panels rotate and change direction, or (c) a rigid shutter, wherein the motorized driving mechanism drives the rotation of an axle which moves the rigid shutter in the plane of said area in the first and second directions, preferably by means of a gear system; cables, or chains.

12. A motorized door according to claim 1, wherein $M>0$.

* * * * *